United States Patent [19]

Triner

[11] Patent Number: 4,569,566

[45] Date of Patent: Feb. 11, 1986

[54] PLUG AND RECEPTACLE CONNECTOR ASSEMBLY

[75] Inventor: Irvin R. Triner, Stickney, Ill.

[73] Assignee: Molex Incorporated, Lisle, Ill.

[21] Appl. No.: 688,676

[22] Filed: Jan. 4, 1985

[51] Int. Cl.[4] ..... H01R 4/24

[52] U.S. Cl. ..... 339/99 R; 339/143 R

[58] Field of Search ..... 339/17 C, 97 R, 97 P, 339/98, 99 R, 143 R

[56] References Cited

U.S. PATENT DOCUMENTS

| | | | |
|---|---|---|---|
| 3,860,316 | 1/1975 | Hardesty | 339/91 R |
| 4,054,350 | 10/1977 | Hardesty | 339/99 R |
| 4,415,223 | 11/1983 | Asick | 339/276 R |
| 4,457,575 | 7/1984 | Davis et al. | 339/143 R |

*Primary Examiner*—Joseph H. McGlynn
*Attorney, Agent, or Firm*—Louis A. Hecht

[57] ABSTRACT

Disclosed herein is an improved plug and receptacle connector assembly for use with shielded cables. The assembly includes a plug, connected to the shielded cable, having a mating end received within a receptacle housing which is mounted to a printed circuit board. Plug terminals located adjacent the mating end of the plug each have a pair of spaced-apart outwardly extending contact projections, with a receptacle terminal receiving region formed therebetween. The receptacle terminals include a cantilevered contact portion mounted in the receptacle housing, having a concave region received between the plug terminal contact projections, when the plug and receptacle are mated for separable electrical connection.

The outside surface of the plug is enclosed by a stamped conductive shield member having free ends which are butted together to form an axial seam. The free ends of the shield adjacent the seams are reversely bent to form transverse flanges which slidingly engage the plug housing to prevent separation of the shield seam, and to provide secure engagement between the plug housing and shield members. Two preferred embodiments of the invention are described, one for a flat cable arrangement and the other for a round cable arrangement. The two plug embodiments are mateable with the same receptacle arrangement.

10 Claims, 5 Drawing Figures

PLUG AND RECEPTACLE CONNECTOR ASSEMBLY

BACKGROUND OF THE INVENTION

1. Field of the Invention

This invention pertains to improvements in plug and receptacle connector assemblies, and in particular to shielded assemblies of the type used in telephone or data transmission wherein the receptacle is mounted to a printed circuit board or the like.

2. Brief Description of the Prior Art

In the telephone and digital electronic industries, increasing use is being made of modular plug type connectors which have sliding contacts located adjacent a mating end thereof. The plugs are typically received within receptacle housings having bent receptacle terminals with cantilevered portions which slideably mate with the plug terminals to establish a separable electrical connection therewith. A disadvantage of prior art connector assemblies has been the resulting expulsion force generated by the cantilevered terminals, which impart a withdrawal force to a mated plug.

Further, prior art receptable terminals include medial portions supported against an outside surface of the receptacle housing, which are exposed to flux contamination, and solder bridging.

Previous receptacle designs also required insertion of the receptacle terminals through an outside wall of the receptacle housing, with the terminals frequently being fully formed after insertion. A fully automated terminal formation and receptacle assembly would offer an economy of manufacture.

One example of a prior art connector arrangement is shown in U.S. Pat. No. 4,054,350 issued to Hardesty on Oct. 18, 1977. A modular plug for connection to a non-planar, round cable includes cable receiving passageways which extend to the mating end of the plug, providing a ready indication of cable insertion. Also shown in the patent, is a single point of contact between the plug terminal and a cantilevered receptable terminal. If possible, redundant contact points are preferred to assure adequate electrical connection. Further, the bias force of the receptable terminal tends to urge expulsion of the plug from the receptable assembly.

During plug insertion, the free ends of the receptacle terminals are not controlled, being subject to distortion caused by lateral froces generated during plug and receptacle mating. A partial solution to this problem is found in U.S. Pat. No. 3,369,214 issued to Krumreich, et al. on Feb. 13, 1968. As disclosed therein, the cantilevered receptacle terminals have their free ends supported by a housing wall portion, an arrangment which imparts a preload stress to the receptacle terminal and protects the free end of the terminal during plug insertion. However, there is no positive retention between the plug and receptacle terminals, and no redundant contact mating is provided.

There has been an increasing need to provide shielding for the plug and connector assemblies. One inexpensive plug shield arrangement described in AMP Incorporated's Data Sheet 83-694 issued September, 1983, includes a stamped and formed integral sheet metal collar having abutting free ends joined at a longitudinal seam, with the collar being inserted over a plug housing so as to surround the plug. However, the abutting ends have a tendency to separate, allowing leakage of radio frequency and electromagnetic inteference therebetween.

SUMMARY OF THE INVENTION

It is therefore an object of the present invention to provide a plug and receptacle connector assembly wherein the plug terminals are positively retained in electrical connection with the receptacle terminals.

Another object of the present invention is to provide a receptacle assembly whereby the receptacle terminals are protected during mating engagement with plug.

Still another object of the present invention is to provide not only mechanical control over receptacle terminal distortion, but also to impart a preload tension stress to the receptacle terminals to provide control over the contact pressures when the terminal is mated to the plug connector.

It is also an object of the present invention to provide an improved plug assembly wherein the plug housing includes through-holes for receiving cable conductors, with free ends of the cable conductors extending past the mating end of the plug to give a positive visual indication of adequate cable insertion.

Yet another object of the present invention is to provide an improved shielding system for a plug connector, which provides control over an abutting edge seam of the plug shield member.

These and other objects of the present invention are provided in an electrical plug and receptacle connector assembly, the plug including a plug housing having a first mating end and a second opposed conductor receiving end, oppositely facing top and bottom plug walls, a conductor receiving recess adjacent said second end for receiving an insulated conductor therein, contact receiving cavities located adjacent the mating end and communicating with the bottom plug wall and the conductor receiving recess, plug terminals mounted in the cavities each having insulation piercing portions for making electrical connection with the conductor and an outwardly extending contact projection, the receptacle including a receptacle housing having a mating face with a plug receiving cavity extending into the housing from the mating face, an end wall opposite the mating face, opposing top and bottom receptacle housing walls, and receptacle terminals mounted in the receptacle housing, each terminal having a circuit connecting portion at one end extending outside the receptacle housing and a cantilevered contact portion at the other end extending into the plug receiving cavity for slideable mating contact with said plug terminal contact projection, the electrical connector assembly being characterized in that:

each plug terminal including another outwardly extending contact projection spaced apart from the one contact projection defining a receptacle terminal receiving region therebetween; and each receptacle terminal contact portion including a concave region dimensioned to be received within the terminal receiving region between the contact projections of the plug terminal.

DESCRIPTION OF THE DRAWINGS

In the drawings, wherein like elements are referenced alike:

FIG. 4 is an exploded perspective view of an alternative round cable plug arrangement according to the invention for.

DETAILED DESCRIPTION OF THE PREFERRED EMBODIMENT

Figure 1:
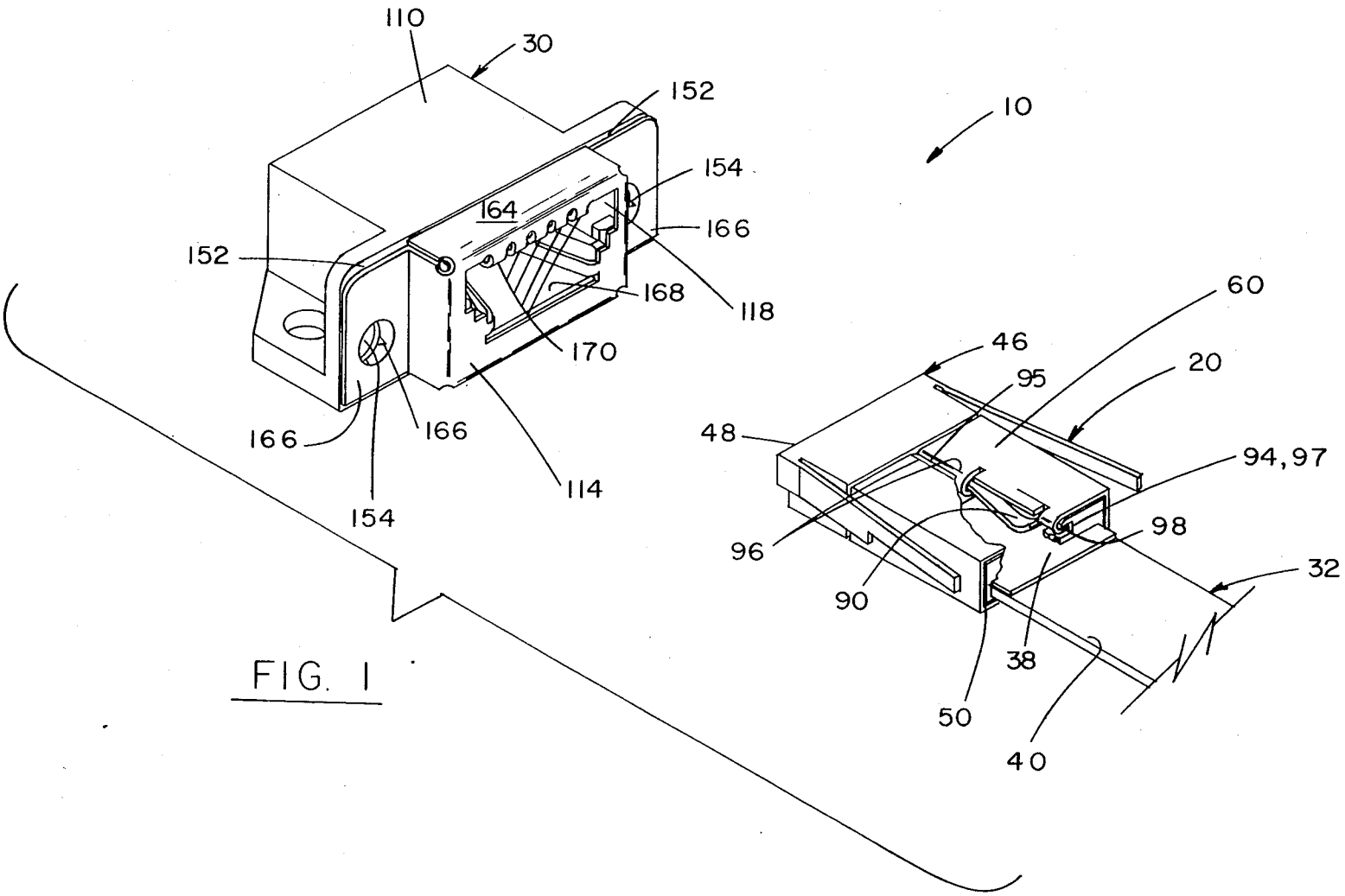
FIG. 1 is a perspective view of a plug and receptacle assembly according to the present invention shown prior to electrical mating.
Figure 3:
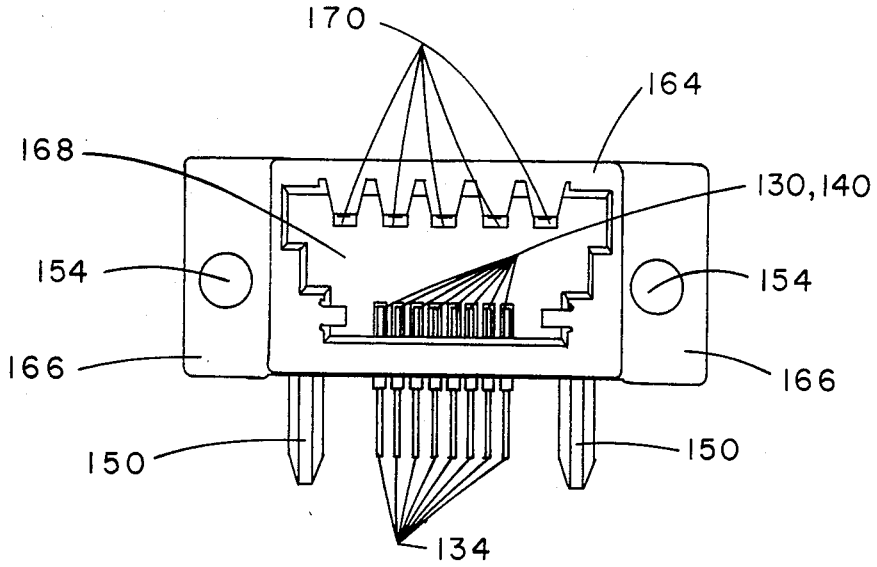
FIG. 3 is an elevational view of the receptacle of FIGS. 1 and 2.

Referring now to the drawings, FIG. 1 shows a plug and receptacle assembly generally indicated at 10, comprising a plug member 20 adapted to be received within a receptacle member 30. Plug member 20 is connected to a conventional multi-conductor round wire flat cable 32 which is also shown in FIG. 3. Cable 32 comprises a plurality of signal conductors 34 each surrounded by an insulation layer 36. Surrounding the conductors 34, is an electrically conductive shield member 38 which is protected by an outer jacket 40 of the cable assembly.

Figure 2:
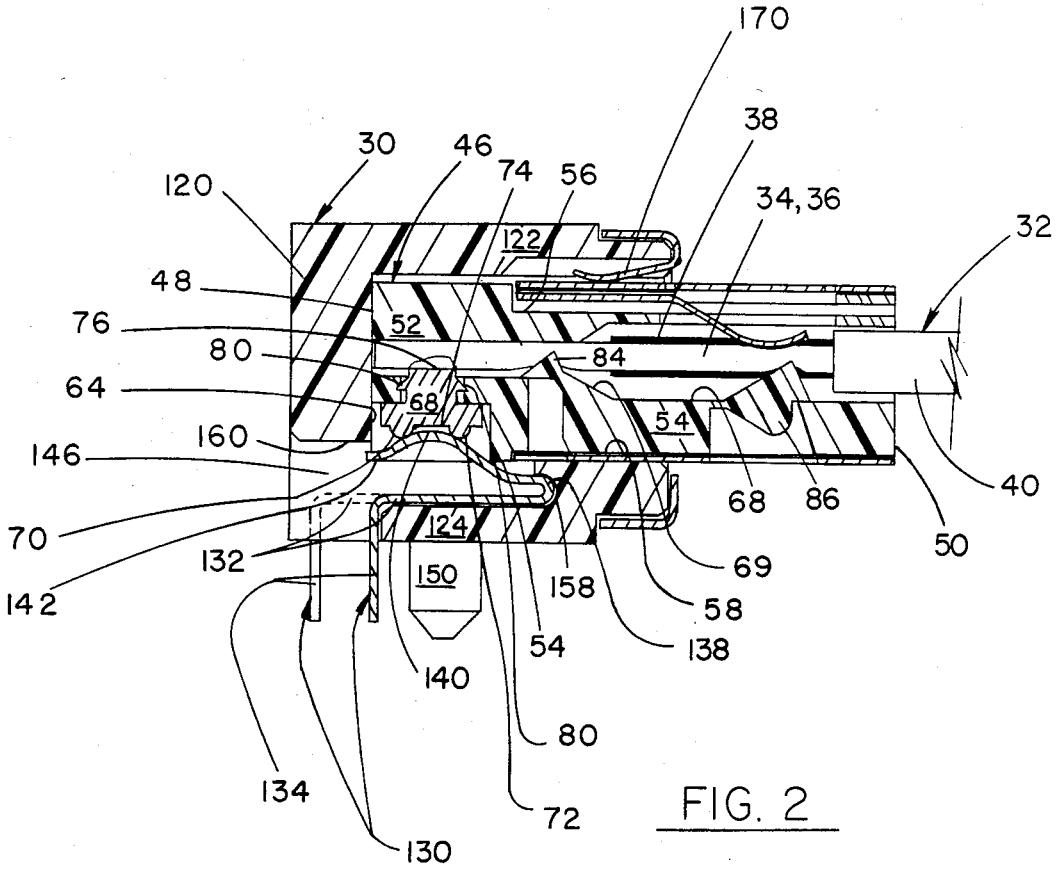
FIG. 2 is an elevational cross section view of the assembly of FIG. 1 shown in a fully mated condition.

Referring now to FIGS. 1 and 2, plug member 20 comprises a plug housing 46 having a mating end 48 and an opposed conductor receiving end 50. Housing 46 also includes oppositely facing top and bottom walls 52, 54 respectively, with recesses 56, 58 formed therein to accommodate a shield member 60 which is slid over the rearward end of housing 46, adjacent conductor receiving end 50. Housing 46 has a conductor receiving passageway 68 extending throughout the entire length of housing 46, communicating with both the mating end 48 and the conductor receiving end 50. A portion of conductor receiving passageway 66 adjacent the conductor receiving end 50 is enlarged to accommodate the additional thickness of jacket 40 and shield 38 which, after being folded back, are inserted within the passageway. As shown in FIG. 1, plug shield 60 includes an outwardly struck finger-like shield engaging member 90, which contacts metallic cable shield 38 to form a direct electrical connection between cable shield 38 and the shield member 60.

Figure 4:
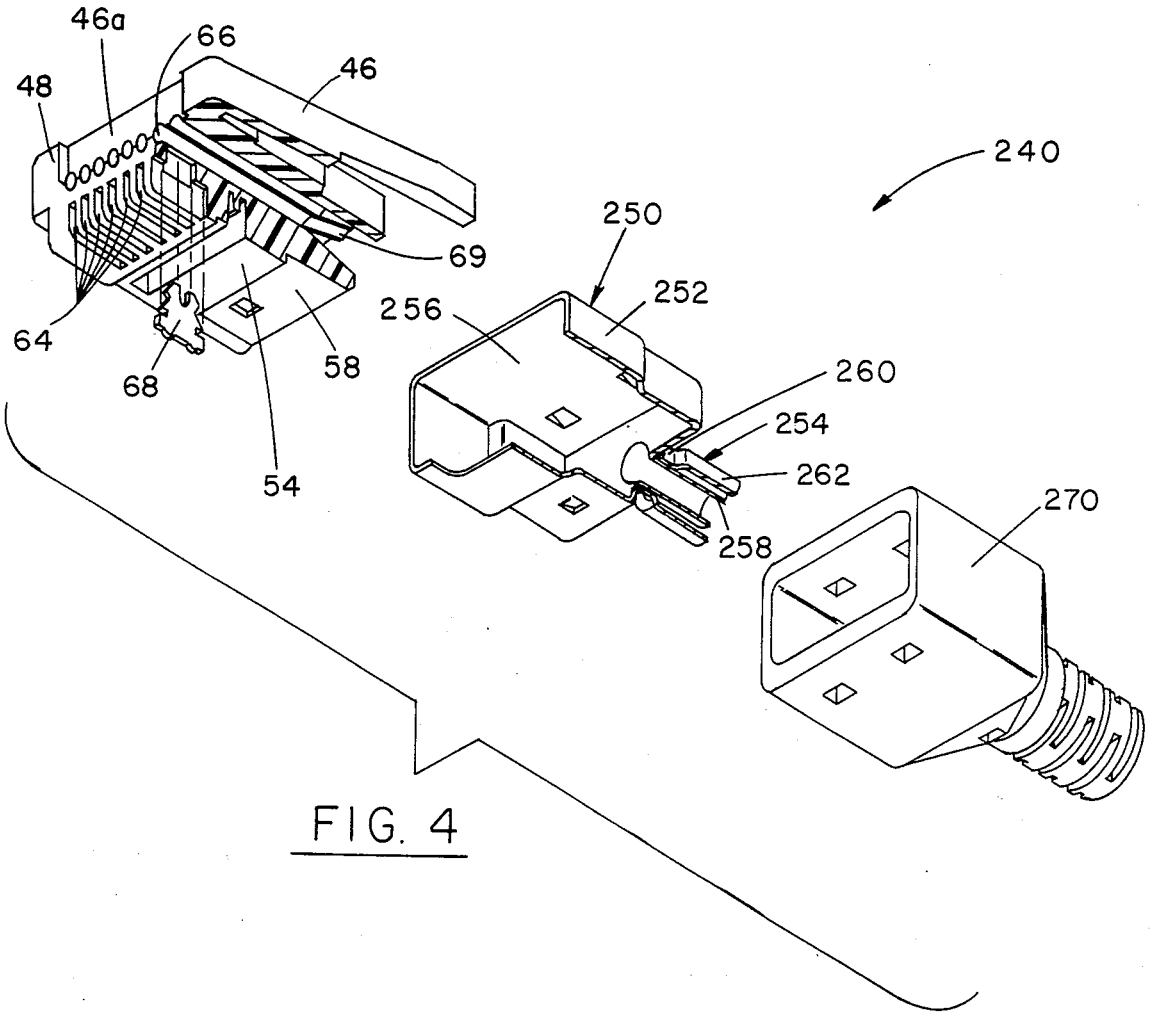

The forward end of passageway 66 has a reduced cross sectional area, corresponding to that of the signal conductors 34 with their surrounding insulation layers 36. As can be seen in FIG. 2, conductor receiving passageway 68 includes a smooth scallop like transition 69 to assist in directing the free ends of signal conductors 34 through the forward reduced diameter portion of passageway 68. As indicated in FIG. 2, the forward free ends of conductors 34 extend to the mating face 48 of the plug housing. In practice, the free ends of conductors 34 extend beyond mating ends 48, and are thereafter cut away in one of the finishing steps of plug assembly. As indicated in FIG. 4, the upper portion of mating end 48 can be formed to include a recess 46*a* which, in combination with passageway 66, facilitates the cutting of conductors 34 as close to the surface of mating end 48 as possible.

Housing 46 further includes terminal receiving cavities 64 extending into housing body 46 from bottom wall surface 54 thereof. Received within terminal cavities 64 are a plurality of terminals 68, each of which have a pair of outwardly extending contact projections 70, 72 adjacent one end thereof, and an insulation piercing portion 76 at an opposing end. Also included in terminal 68 are outwardly projecting barb-like retention means 80 which engage housing 46 during terminal insertion.

A cavity-like region 74, formed between outwardly extending contact projections 70, 72 receives a concave receptacle terminal portion for secure engagement therewith. After insertion of cable 32 within plug housing 46, with the free ends of conductors 34 extending beyond the mating end 48 of the plug housing, terminals 68 are fully inserted such that terminal ends 76 pierce the insulation layers 36 surrounding the respective conductors, so as to form an electrical connection between terminals 68 and conductors 34. After insertion of cable 32 and housing 46, strain relief tabs 84, 86 are driven into conductor insulation layer 36 and outer jacket 40 respectively to provide strain relief with cable assembly 32.

Plug shield 60 will now be described with reference to FIGS. 1 and 2, wherein top wall 52 of plug housing 46 includes an axially extending channel 94, communicating with the conductor receiving end 50 of housing 46. Cable shield 60 is an integral box-like shell, being stamped and formed from a sheet metal blank so as to have a generally rectangular cross sectional shape with abutting free ends 96 forming a seam 95. Free ends 96 are rolled over, being reversely bent to form transverse flanges 98 which are slidingly received within plug housing channel 94. As can be seen in the FIG. 1, channel 94 comprises an axially extending relatively narrow slot communicating with outwardly extending undercut recesses 97 formed beneath housing top wall 52. When received in channel 94, flanges 98 are held captive within the slot preventing outward separation of the abutting ends forming shield seam 95. Further, engagement of flanges 98 with the undercut recesses 97 prevents dislodging of the shield from the plug housing thereby providing secure engagement with housing 46.

Referring now to FIGS. 1, 2 and 3, receptacle 30 includes a receptacle housing 110 having a mating face 114 with a plug receiving cavity 118 extending into the housing from the mating face. Housing 110 also includes an end wall 120 located opposte mating face 114, and opposing top and bottom receptacle walls 122, 124 respectively. Receptacle 30 further includes a plurality of staggered receptacle terminals 130 having medial body portions 132 and circuit connecting tail portions 134 extending through bottom receptacle housing wall 124 in a transverse direction. As can be seen most clearly in FIG. 2, terminals 30 include a reversely bent mounting portion 138 and a cantilevered contact portion having a concave region 140, adjacent a terminal free end 142. The end wall 120 of receptacle housing 110 includes a slot or opening 146 for sliding reception of terminal 130 within housing 110. This arrangement affords advantageous automated manufacturing techniques for loading the terminals within the receptacle housing.

As can be seen in FIG. 2, the medial body portions 132 of terminals 130 are of two different lengths, so as to form a staggered footprint pattern commonly employed in printed circuit board layout designs. Of course, by varying the depth which slots or openings 146 extend into housing 110 from end wall 120, different arrangements of solder tails can be realized. Integrally formed with housing 110 adjacent bottom wall 124 are housing retention pins 150 of the type commonly employed for securement in a printed circuit board. An alternative mounting arrangement is provided by mounting ears 152, having mounting holes 154 formed therein, for convention securement in mounting panels, chassis structures and like frame members.

When inserted in housing 110, reversely bent mounting portions 138 of terminals 130 comprise a leading end which is rounded for easy insertion in slots 146. As is most clearly shown in FIG. 2, pockets 158 are formed in housing bottom wall 124 to receive mounting portions 138, providing a blind entry arrangement wherein the medial body portions 132 and reentrant bend portions 138 are protected from contact with the mating end of plug 20 during plug insertion. This feature provides a degree of protection for the leading end of the terminal contact portion, which prevents terminal distortion caused by engagement with plug 20.

Further, as can be seen in FIG. 2, slot 146 forms a stop surface 160 in end wall 120 which engages the free end 142 of terminal 130 to impart a preload tensioning to the terminal, as well as protecting the trailing free end of contact surface 140. The receptacle arrangement 30 provided herein maintains a complete control over the contact portion of the receptacle terminals 130, with the leading end being maintained in fixed position by pockets 158, and the trailing ends 142 of the terminal contact portion being secured through engagement with stop surface 160 of end wall 120. If desired, stop surface 160 can include inwardly extending depressions or pockets to receive and more firmly engage terminal free ends 142.

With reference to FIG. 1, receptacle 30 is provided with a shield member 164, secured to the mating face 114 of housing 110. Shield 164 includes mounting ears 166 which overlie mounting ears 152 of housing 110, wherein shield portions 166 are drifted into apertures 154 so as to be clinched or otherwise secured to housing mounting ears 152. A plug receiving aperture 168 of shield 164 is aligned in registry with the mouth-like opening of housing cavity 118. Integrally formed with the stamped shield 164 are contact fingers 170 which are bent over so as to extend into housing cavity 118, toward housing end wall 120.

The receptacle arrangement shown herein is intended for mounting within an electrically conductive chassis member, and therefore shield 164 encloses only the mating face receptacle housing 110. If desired, shield 164 can be conventionally designed so as to enclose the remaining portions of housing 110 if necessary. When plug 20 is fully inserted within receptacle 30, contact fingers 170 wipe across the upper surface of plug shield 60, establishing electrical grounding contact between plug shield 60 and receptacle shield 164.

As can be seen most clearly in FIG. 2, plug terminal 68, as outwardly extending contact projections 70, 72 formed on either side of the cavity region 74, engage the concave contact region 140 of receptacle terminal 130. The mating of plug and receptacle terminals provides a positive engagement, while overcoming the tendency to disengage experienced by prior art connectors. Prior art receptacle terminals typically include a cantilevered beam having a free end which imparts a bias force to the mating plug contact, in a direction urging expulsion of the plug from the receptacle. The terminal arrangement the present invention also provides an increasingly popular redundant contact arrangement which insures an adequate electrical connection.

As will be appreciated by those skilled in the art, the circuit connecting tail portions 134 present a minimum risk of contamination when receptacle 30 is mounted to a printed circuit board, with the terminal portions 134 being soldered to conductive pads of the printed circuit boards. The receptacle arrangement shown herein provides retention of medial terminal portions 132 within the housing, remote from the possibility of contamination, and provides an arrangement wherein terminals 130 extend at right angles beyond the outer surface of bottom wall 124. A fully automated assembly of receptacle is possible with receptacle terminals being slidingly loaded in housing 110, through rearward opening 146 avoided.

Figure 5:
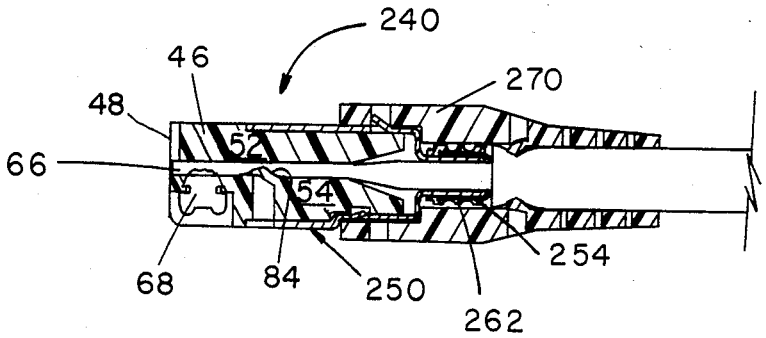
FIG. 5 is a cross sectional elevational view of the fully assembled plug of FIG. 4.

Turning now to FIGS. 4 and 5 an alternative round cable plug arrangement 240 is illustrated. The housing and terminal portions of plug assembly 240 are substantially identical to that previously described for the flat cable version described with reference to FIGS. 1–3. The principle difference resides in cable shield 250, shown most clearly in the middle portion of FIG. 5. Cable shield assembly 250, comprised of an integral unitary body portion 252, and a ferrule portion 254 held captive on body portion 252, is presented as a unitary assembly to the end user. Assembly 250 includes a plug receiving end 256 and an opposing cylindrical cable receiving portion 258 which is inserted between the conductors and the surrounding shield portion of a conventional shielded round cable assembly. Ferrule 254 includes a body engaging portion 260 and a shield engaging portion 262. When assembled to the shield 250, the round cable is prepared by removing an outer jacket so as to expose the surrounding metallic shield, the free end of which is inserted between portions 258, 254.

Thereafter, as indicated in FIG. 5, ferrule 254 is crimped so as to provide secure engagement between the cable shield of ferrule 254 and the conductor engaging portion 258 of shield body 252. Ferrule 254 is held captive on the conductor engaging portion 258 of body 252 by being crimped at the body engaging end 260 so as to be held captive on body 252. As will be appreciated by those skilled in the art, this assembly provides a unitary shield assembly for the end user, which can be conveniently shipped and handled prior to final assembly without requiring the inventory and fabrication of additional ferrule shield body portions units. After assembly of plug portions and shield 250, a flexible strain relief 270 is slid over the assembled plug.

We claim:

1. An electrical plug and receptacle connector assembly, the plug including a plug housing having a first mating end and a second opposed conductor receiving end, oppositely facing top and bottom plug walls, a conductor receiving recess adjacent said second end for receiving an insulated conductor therein, contact receiving cavities located adjacent the mating end and communicating with the bottom plug wall and the conductor receiving recess, plug terminals mounted in the cavities each having insulation piercing portions for making electrical connection with the conductor and an outwardly extending contact projection, the receptacle including a receptacle housing having a mating face with a plug receiving cavity extending into the housing from the mating face, an end wall opposite the mating face, opposing top and bottom receptacle housing walls, and receptacle terminals mounted in the receptacle housing, each terminal having a circuit connecting portion at one end extending outside the receptacle housing and a cantilevered contact portion at the other end extending into the plug receiving cavity for slideable mating contact with said plug terminal contact projection, the electrical connector assembly being characterized in that:

each plug terminal including another outwardly extending contact projection spaced apart from the one contact projection defining a receptacle terminal receiving region therebetween; and each receptacle terminal contact portion including a concave region dimensioned to be received within the terminal receiving region between the contact projections of the plug terminal.

2. The connector assembly of claim 1 wherein said receptacle housing end wall includes a stop surface and said contact portion of each receptacle terminal includes a free end adjacent the concave region for engaging the stop surface to maintain said receptacle terminal in a preloaded biased condition when said terminal is mounted in the receptacle housing.

3. The connector assemby of claim 1 further including a stamped metallic conductive shield having an integral body portion surrounding said plug housing and a cable receiving portion extending therefrom, said shield further having a ferrule held captive on and overlying cable receiving portion to form a cavity for receiving a conductive shield member, said ferrule adapted to be crimped about said conductive shield member.

4. The connector assembly of claim 1 wherein said receptacle housing end wall has terminal receiving openings through which said receptacle terminals are slideably inserted for mounting in said receptacle housing.

5. The connector assembly of claim 4 wherein each receptacle terminal includes a mounting portion intermediate the circuit connecting portion and the contact portion, said mounting portion having a reverse bent portion joined to the contact portion to provide an outwardly directed bias force to the contact portion, and said receptacle housing includes a plurality of terminal receiving pockets adjacent said mating face for receiving the bent portions therein.

6. The connector assembly of claim 4 wherein each of said receptacle terminal circuit connecting portions includes a solder tail adapted to be connected to a circuit board, said receptacle housing bottom wall defining a plurality of apertures for receiving said solder tails so that they protrude from said receptacle housing bottom wall at right angles thereto to minimize degradation of electrical contact of said receptacle terminals when said terminals are connected to a circuit board.

7. The connector assembly of claim 1 wherein said connector assembly further includes an integral stamped metallic conductive shield surrounding said plug housing having first and second abutting ends forming a seam, both of said ends including a transverse flange extending into the plug housing to maintain said ends in abuttment.

8. The connector assembly of claim 7 wherein said top plug wall includes an elongated channel formed therein and wherein the ends of said shield are reversely bent to form said flanges which are slidingly received within said channel.

9. The connector assembly of claim 1 wherein said plug housing further includes a conductor receiving passageway extending between said conductor receiving recess and said first mating end, and a recess portion formed in said mating end extending from said plug top wall to said conductor receiving passageway.

10. The connector assembly of claim 9 wherein said conductor receiving passageway is of smaller cross-sectional size than said conductor receiving recess, and said plug housing further includes a scalloped-like transition between said conductor receiving recess and said conductor receiving channel.

* * * * *